United States Patent [19]

Ho

[11] Patent Number: 4,579,540

[45] Date of Patent: Apr. 1, 1986

[54] RADIO TOY

[75] Inventor: Karl Ho, Taipei, Taiwan

[73] Assignee: Giraffe Industrial Co., Ltd., Taipei, Taiwan

[21] Appl. No.: 597,604

[22] Filed: Apr. 6, 1984

[51] Int. Cl.[4] ..... A63H 3/28; G09F 27/00

[52] U.S. Cl. ..... 446/301; 446/139; 446/484; 455/344; 40/457

[58] Field of Search ..... 446/129, 137, 139, 297, 446/298, 299, 300, 301, 303, 484; 455/344, 347; 40/457, 902

[56] References Cited

U.S. PATENT DOCUMENTS

| | | | |
|---|---|---|---|
| 1,726,294 | 8/1929 | Greene | 446/303 X |
| 1,927,453 | 9/1933 | Hill | 455/344 X |
| 2,184,675 | 12/1939 | Kehm | 40/457 |
| 2,247,329 | 6/1941 | Deitz | 40/457 |
| 2,470,384 | 5/1949 | Waldron | 455/344 |
| 2,603,912 | 7/1952 | Gruber | 40/457 |
| 4,027,425 | 6/1977 | Morrison et al. | 446/299 |

FOREIGN PATENT DOCUMENTS

| | | | |
|---|---|---|---|
| 525317 | 5/1956 | Belgium | 446/301 |
| 1206425 | 9/1970 | United Kingdom | 446/129 |

*Primary Examiner*—F. Barry Shay

*Attorney, Agent, or Firm*—Finnegan, Henderson, Farabow, Garrett & Dunner

[57] ABSTRACT

A radio toy having a plastic toy structure with a body portion erectly fixed on the top of a hollow base and a head portion with a movable lower jaw disposed on the top of the body portion, includes a radio set installed in the hollow base and a magnetic device provided in the mouth of the toy structure in connection with the radio set; thereby, opening and closing of the toy mouth will be automatically effected along with the amplitude of the audio frequency produced by the radio set so as to increase the amusing actions of the radio toy and to stimulate the intelligence of the player.

3 Claims, 4 Drawing Figures

RADIO TOY

BACKGROUND OF THE INVENTION

This invention relates to a radio toy, particularly to a type of radio toy having a magnetic device disposed in its mouth for effecting the opening and closing of the toy's mouth relative to the amplitude alteration of the audio frequency of the radio set installed therein.

As toys are favorites of children the world over, various kinds of electronic toys have been produced for promoting playing interest. However, the conventional electronic toys are usually provided with sound producing units for attracting the player's attention. The sound producing units in the known toys are generally monotonous and are even noisy, without serving much purpose in the way of amusement, and contributing little to the player's intelligence.

SUMMARY OF THE INVENTION

It is accordingly a primary object of this invention to provide a radio toy with an electromagnetic device arranged in conjunction with the radio set installed therein so as to effect the opening and closing of the toy's mouth for increasing the toy's amusement value and for stimulating the intelligence of the children.

According to the present invention, this and other objects are achieved by providing a radio toy having a hollow base, a plastic toy body erectly fixed on the hollow base, and a radio set disposed in the hollow base, with an audio-frequency control circuit electrically coupled with the radio circuit and an electromagnetic device disposed in the toy mouth in conjunction with the the audio-frequency control circuit so that the opening and closing of the toy's mouth are automatically effected relative to amplitude alteration of the audio frequency of the radio set.

Other characteristics and advantages of this invention will become apparent from the following detailed description with reference to the accompanying drawings.

DETAILED DESCRIPTION OF THE PREFERRED EMBODIMENT

Figure 1:
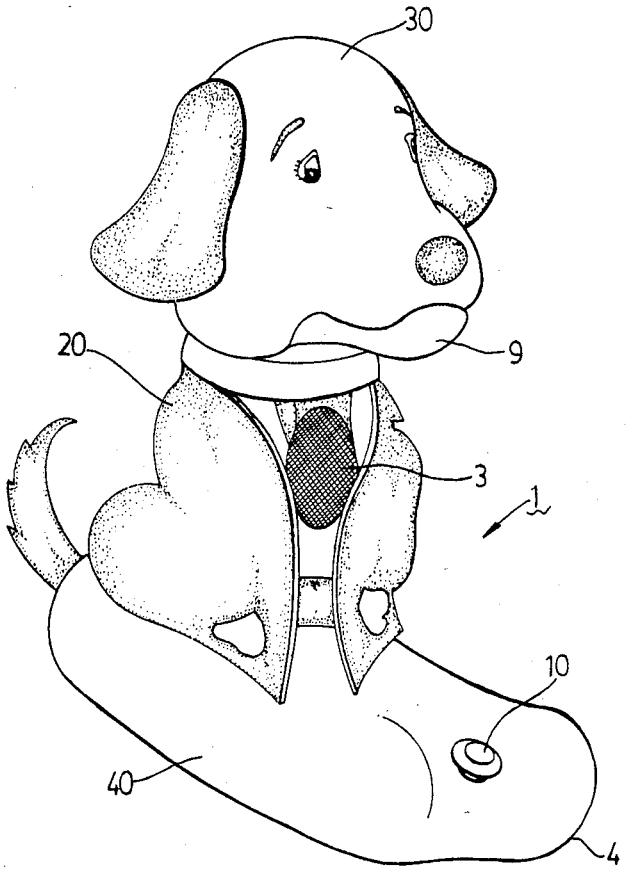
FIG. 1 is an illustrative view of a preferred embodiment of a radio toy according to this invention.

Referring to FIG. 1, there is shown a preferred embodiment of a radio toy according to this invention, which radio toy includes: a plastic toy structure 1 having a hollow base 4 with a cover 40 detachably provided on the bottom side; a toy body portion 20 with a speaker 3 disposed therein fixed in an upright position on the top surface of the body portion 20; a head portion 30 with a movable lower jaw 9 disposed on the top of the body portion 20; and a rotary tuning knob 10 installed in the front portion of the base 4.

Figure 2:
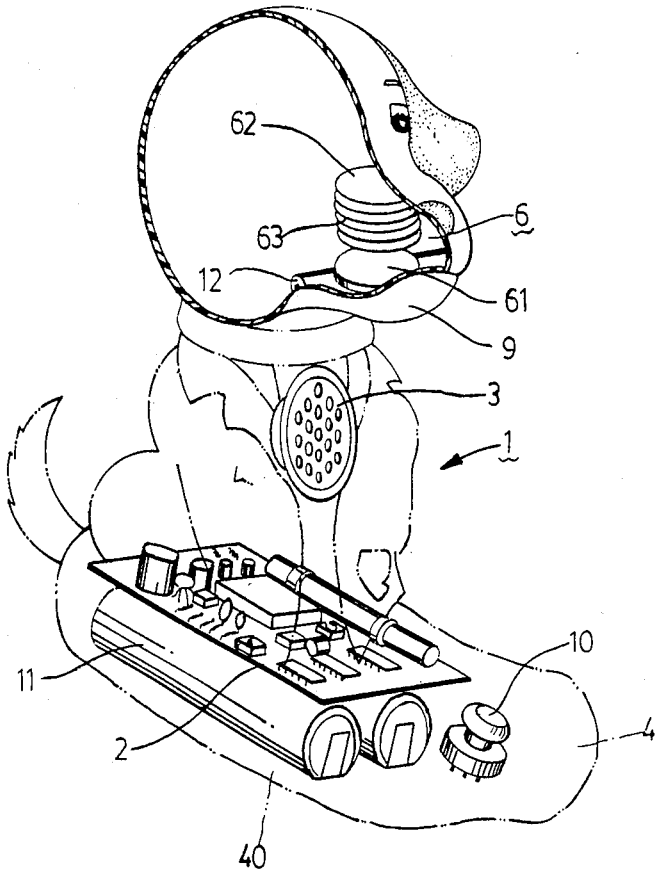
FIG. 2 is a schematic illustration of the inner structure of the preferred embodiment shown in FIG. 1.

Referring to FIG. 2, the inner structure of the preferred embodiment shown in FIG. 1 comprises: a radio set built on a substrate installed in the hollow section of the base 4 in connection with the rotary tuning knob 10 and the speaker 3; a battery set 11 replaceably provided under the substrate of the radio set 2 for supplying electrical power to the radio set 2; and a magnetic control device 6 disposed in the head portion 30 in conjunction with the radio set 2. The magnetic device 6 is a combination of a natural magnet 61 fixed on the surface of the lower jaw 9, which is pivotally connected to the upper jaw of the head portion 30 through a pivot pin 12, and an electromagnet 62 coupled with a coil 63 provided in the upper jaw of the head portion 30 in line with the natural magnet 61 for repulsion and attracting motions.

Figure 3:
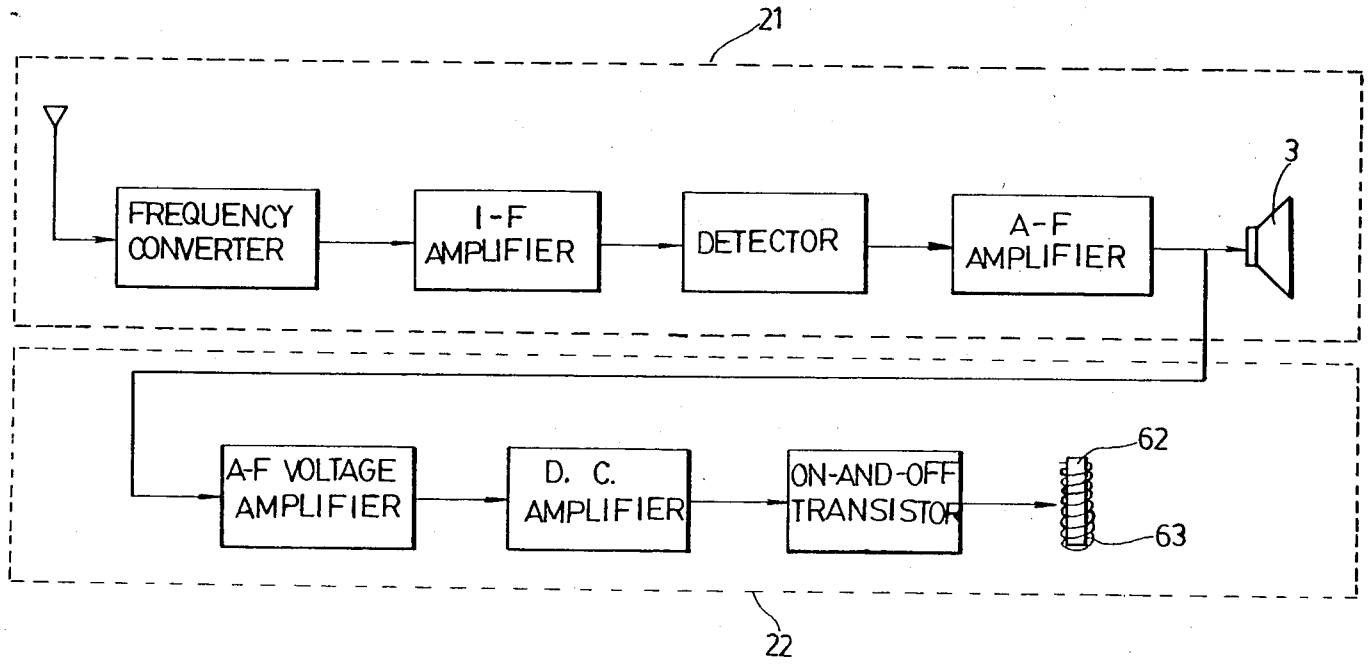
FIG. 3 is a block diagram of a radio set with a radio receiving portion and an audio-frequency control portion disposed in the preferred embodiment of FIG. 1.
Figure 4:
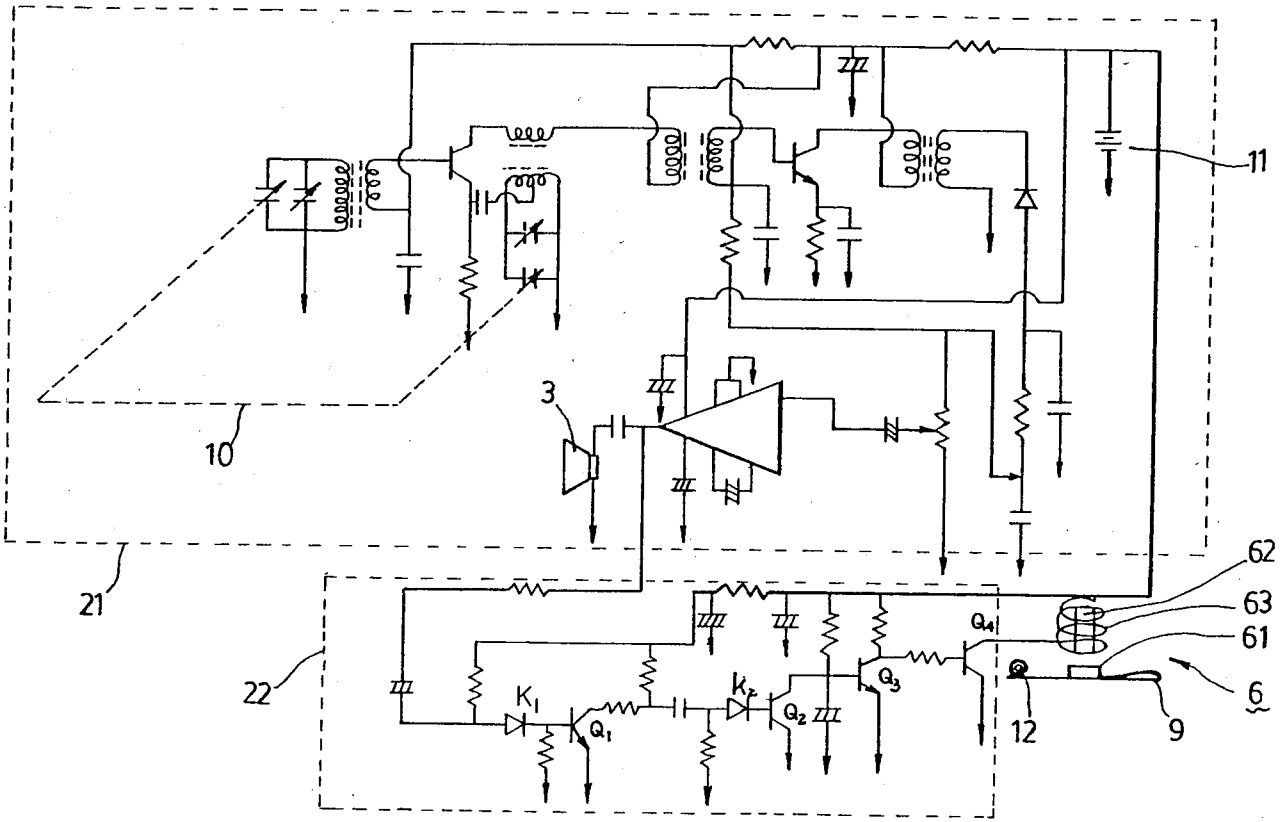
FIG. 4 is a circuit diagram of the radio set and the audio-frequency control arrangement of FIG. 3.

Referring to FIGS. 3 and 4, there is shown a practical circuitry arrangement for the preferred embodiment according to this invention, which circuitry arrangement includes a radio receiving portion 21 and an audio-frequency control portion 22 functionally coupled with the radio receiving portion 21 as shown in FIG. 3. The radio receiving portion 21 is arranged according to the known art and is combined with a frequency converter, an I-f amplifier, a detector, and an audio-frequency amplifier (since this design is well known by those skilled in the art, its details are herein omitted). The audio-frequency control portion 22 includes: an audio-frequency voltage amplifier connected to the output of the audio-frequency amplifier of the radio receiving portion 21; a d.c. amplifier coupled with the output of the audio-frequency voltage amplifier, and an on-and-off transister connected between the output of the d.c. amplifier and the electromagnetic coil 63. As shown in FIG. 4, when the radio receiving portion 21 is tuned to a radio station through the rotary tuning knob 10, which is also combined with a volume control function, the audio-frequency signal from the audio-frequency amplifier of the radio receiving circuit 21 will, in addition to driving the speaker 3 for producing the musical sound, be partially developed across the input of the audio-frequency voltage amplifier of the audio-frequency control circuit 22 and rectified into a d.c. pulsating signal by a diode K1 for being amplified by a transistor Q1. This amplified pulsating audio signal is then continuously amplified through a two-stage d.c. amplifying circuit combined by a transistor Q2 and a transistor Q3 and fed into a transistor Q4 which is arranged for effecting on-and-off operations in conjunction with the signal amplitude coming from the output of the d.c. amplifying circuit. Therefore, the transistor Q4 is actuated to conduct thereat, and the magnetic coil 63 connected between the collector of the transistor Q4 and the power line of the radio receiving circuit 21 is energized with the electromagnet 62 excited therein, resulting in the production of the same polarity as that of the natural magnet 61 and causing a repulsion force therebetween. Consequently, the lower jaw 9 of the toy head is pushed downward causing the mouth to open. When the amplitude of the audio signal from the audio-frequency amplifier of the radio receiving circuit 21 is attenuated, the output from the transistors Q2 and Q3 will also be decreased, and the transistor Q4 is cut off thereat. As a result, the circuit between the collector of Q4 and the coil 63 is open without d.c. power flowing therein. Thus, the electromagnet 62 is deenergized and attracted again by the natural magnet 61, resulting in the pulling of the lower jaw 9 upward and the closing the mouth of the top 1. The opening and closing of the toy mouth will be varied in conjunction with the amplitude alteration of the audio frequency impressed from the radio circuit 21 which is tuned to a radio station by the rotary tuning knob 10. Adjustment can be made at any time by operating tuning knob 10 for exaggerating the amusing actions of this invention.

Having thus described the invention, it is to be understood that many embodiments thereof will suggest themselves without departing from the spirit and scope of this invention. Therefore, it is intended that the specification and drawings be interpreted as illustrative rather than a limited sense.

What is claimed is:

1. A radio toy having a hollow base, a toy body fixed on the top surface of the hollow base, a head portion including a mouth having an upper jaw and a relatively movable lower jaw disposed on the top of the toy body, and a radio set with a speaker in the bottom base adapted to be energized by a power source in the hollow base, comprising: an electrically actuatable magnetic means disposed in the head portion of the toy for effecting the opening and closing of the mouth of the head portion; and in audio-frequency control means electrically coupled with the radio set and with said magnetic means for turning on and off said magnetic means in conjunction with the amplitude of the audio frequency produced by the radio set, said audio-frequency control means comprising an audio-frequency voltage amplifying circuit connected to the output of the audio-frequency amplifier of the radio set for rectifying and amplifying the audio signal thereof; a d.c. amplifying circuit connected to the output of said audio-frequency voltage-amplifying circuit for amplifying the rectified d.c. audio signal thereof; and an on-and-off transistor circuit connected between the output of said d.c. amplifying circuit and said magnetic means.

2. The radio toy of claim 1 wherein said magnetic means comprises: a magnet fixed on the inner surface of the movable lower jaw of the head portion; and an electromagnetic member combined with a coil provided in the upper jaw of the head portion in line with said magnet.

3. The radio toy of claim 2 wherein said on-and-off transistor has a collector and said coil is connected between said collector and the radio set.

* * * * *